United States Patent [19]

Anderson

[11] 4,248,364

[45] Feb. 3, 1981

[54] ARTICLE CARRIER

[76] Inventor: Robert F. Anderson, 4718-10th St., Menominee, Mich. 49858

[21] Appl. No.: 64,552

[22] Filed: Aug. 8, 1979

[51] Int. Cl.³ ..... A45C 7/00; A45C 13/34

[52] U.S. Cl. ..... 224/45 AC; 224/47; 190/50

[58] Field of Search ..... 224/45 AC, 47; 150/28 R, 29, 31, 45, 49, 17, 10, 6, 1.6; 190/41 R, 48, 49, 50, 54, 58 R, 58 C, 57

[56] References Cited

U.S. PATENT DOCUMENTS

| | | | |
|---|---|---|---|
| 1,121,343 | 12/1914 | Flax | 190/50 |
| 1,189,480 | 7/1916 | Pomper | 224/47 |
| 1,403,476 | 1/1922 | Axelman | 150/31 X |
| 1,522,269 | 1/1925 | Recker | 190/50 |
| 1,559,046 | 10/1925 | McLeran | 224/49 |
| 1,599,044 | 9/1926 | Frothingham | 190/50 |
| 1,649,976 | 11/1927 | Pomeranz | 150/1.7 |
| 1,665,184 | 4/1928 | Thrower | 224/45 D |
| 1,861,431 | 5/1932 | Crawford | 224/45 D |
| 1,971,322 | 8/1934 | Miller | 224/49 |

*Primary Examiner*—Steven M. Pollard
*Attorney, Agent, or Firm*—C. Kenneth Bjork

[57] ABSTRACT

A self-standing carrier for articles comprising an elongated flexible web fitted with a plurality of generally U-shaped supporting frame members, the upper ends of the frame members being flexible and connected to handles in the ends of the web.

4 Claims, 5 Drawing Figures

ARTICLE CARRIER

BACKGROUND OF THE INVENTION

1. Field of the Invention

This invention relates to an article carrier and more particularly is concerned with a flexible carrier particularly suited for carrying bulky articles, such as pieces of wood for a stove or fireplace, which also serves as a decorative storage unit for such articles.

2. Description of the Prior Art

U.S. Pat. No. 1,971,322 teaches a flexible sling-like carrier made of paper with handles at each end which is depicted and described as being useful for carrying pieces of wood.

U.S. Pat. No. 1,599,046 relates to a flexible bundle carrier, generally sling shaped, having its corner sections turned in and fastened to the body. This carrier has handles at its ends and a pocket flap across the center of the body on the inside.

U.S. Pat. No. 1,665,184 and 1,861,431 are directed to carriers for blocks of ice. These carriers have a bottom receptacle for holding a block of ice and flexible sides with handles at each end.

U.S. Pat. No. 1,649,976 teaches a rubberized bag for holding wet garments such as bathing suits.

SUMMARY OF THE INVENTION

In general the self-standing carrier and holder of the present invention comprises an elongated, substantially rectangular, flexible web having a handle at each end and fitted with a plurality of spaced apart generally ⊔-shaped supporting frame members extending along its length thereby defining the shape of the bottom and sidewalls of the carrier. These are joined to handles in the ends of the web. Usually, the carrier has end panels attached to the web at its sides along the bottom and partially up the sidewalls, these conforming with the configuration of the ⊔-shaped supports. The end panels, if included, in conjunction with the bottom and sidewalls of the carrier form a pocket. The upper arm portions of the supports are flexible to provide a facility for bending the corresponding upper sidewall portions of the carrier outwardly to facilitate loading or inwardly to enable a person to partially close the top of the carrier and carry it or to bend the top of the sidewalls down to meet with the top of each end panel and provide a cover for the load. Conveniently, each end panel of the carrier can be fitted with a securing means to hold the arms in closed position.

The web material forming the bottom and walls of the carrier can be of any thin, flexible material of suitable strength to hold the wood pieces or other articles to be carried therein which will not crack from multiple bendings of the sidewalls. For optimum in service, the material should be resistant to scuffing and tearing. Cotton, nylon, rayon, and blends of these or other natural and synthetic fibers woven or fabricated into sheets or synthetic polymeric materials such as polyethylene, polypropylene, polyvinyl chloride or the like can be used.

The rectangular web can be formed from a single piece of material or fabricated from a multiplicity of pieces of the same or different materials of construction. For added strength and decorative affect, the edges can be finished with binding.

DESCRIPTION OF THE PREFERRED EMBODIMENTS

Figure 1:
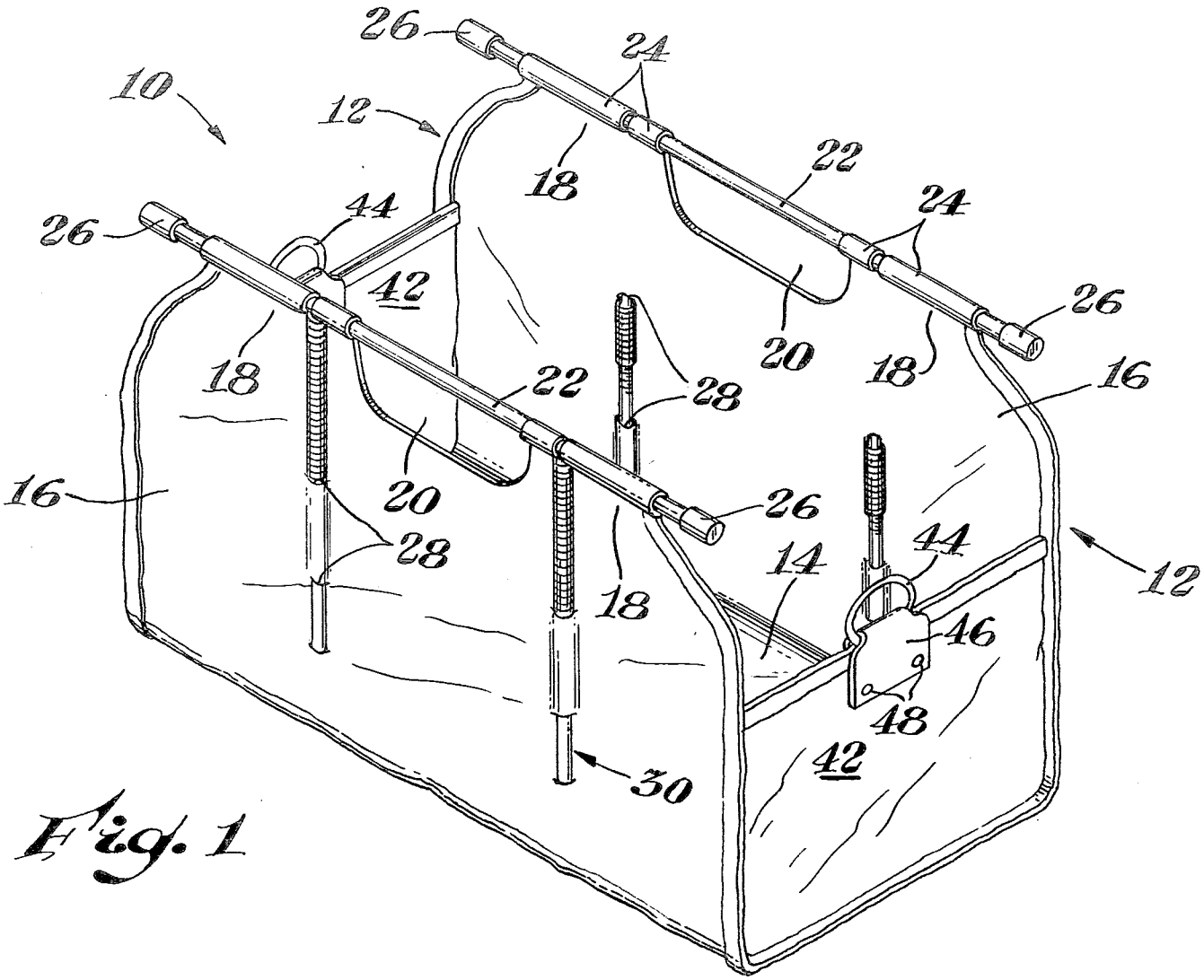
FIG. 1 is a perspective view of one preferred embodiment of the article carrier of the present invention with its sidewalls upright, i.e. with its top in open position.
Figure 2:
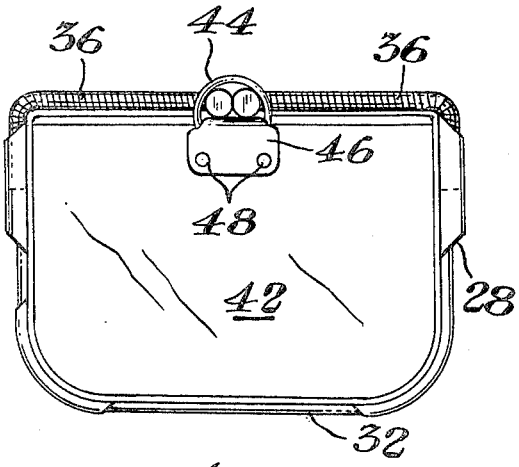
FIG. 2 is an end elevation of the carrier of FIG. 1 with its sidewalls bent down inwardly and secured in closed position.

One preferred embodiment of the carrier 10 of FIGS. 1–4 comprises a substantially rectangular, flexible web member 12 which defines the bottom 14 and sidewalls 16 of the carrier 10. The width of this member 12 is such that it will hold wood pieces of a length ordinarily used in fireplaces and wood stoves, for example, from about 15 to about 24 inches in length. Member 12 is of a length sufficient that the carrier generally will accommodate up to ten or more pieces of wood. Conveniently, the web will range in length from about 36 to about 48 inches or more so as to provide a bottom 14 of from about 10 to about 15 inches across with the two sidewalls 16 making up the remainder of the length.

The ends 18 of the sidewalls 16 are cut out at their midpoint to define an indented portion 20. These serve as openings in the sidewalls 16 for the hand or hands to pass through when a person is holding or carrying the carrier 10.

Affixed to each end 18 of the sidewalls 16 and extending at least from side to side of web 12 is a rigid member 22 which serves as a handle. Ordinarily, the members 22 are rods or tubes and circular in cross-section and constructed of light weight metal, such as aluminum or an aluminum alloy or a rigid polymer. Other cross-sectional shaped rods or tubes can be used; however, the circular cross-section feels very comfortable to the hand.

For ease of construction, the handle members 22 can be slipped through loops 24 formed in the ends 18 of the sidewalls 16. By providing the handles 22 of a length slightly longer than the width of the ends 18, the ends of handles 22 will extend beyond the web 12 and can be held in place by caps or tips 26 of rubber, plastic or similar material and interior opening that will provide a friction fit with the rods 22. Alternatively, the handle members 22 can be adhesively attached or otherwise fastened to the ends 18 of sidewalls 16.

The web 12 defines at spaced apart intervals a number of openings 28 in a plurality of rows along its length. As shown in the depicted embodiment, there are two rows of such openings, one each inwardly from each side edge about $\frac{1}{4}$ to about $\frac{1}{3}$ of the width of the web 12. These openings 28 are of a diameter to accommodate a ⊔-shaped support member 30.

Support member 30 comprises a rod or tubular member, also preferably circular in cross-section. The width of the base 32 of support member 30 defines the width of the bottom 14 of carrier 10. The length of arms 34 of support members 30 are of a length such that the ends of these connect or are fastened to the handles 22. The support 30 and length of web 12 are about the same to provide correspondence in the assembled carrier 10.

The base 32 and lower portion of arms 34 of support members 30 are rigid while the upper portion of these arms are flexible, for example fabricated from coil springs 36.

Conveniently, for ease of construction the upright arms of the lower portions of the rod forming the base 32 and lower arm 34 portions of support 30 have threads 38 which mate with the coils of springs 36 such that the springs 36 can be easily screwed onto the ends of the rod portion to complete the support 30.

The support members 30 are fitted onto web 12 by passing one arm 34 of a support 30 through opening 28 from the outside to the inside wall of the carrier 10 nearest one end of web 12. The arm 34 is then passed outwardly through the next opening 28 in the row. This pattern is repeated until the end of this arm 34 exits from the opening nearest the other end of web 12, thus providing a lattice network wherein the support 30 substantially matches the shape and dimensions of the carrier 10.

Additional supports 30 are similarly fitted through openings 28 in other rows of such openings 28 spaced apart at intervals across the width of web 12 with each row extending along the length of the web 12 as described directly hereinbefore.

The upper ends of the arms 34 of support 30 are fastened to handles 22. In the preferred embodiment depicted in the Figures of the Drawing, the spring 36 is fitted with a loop 40 through which the support rod handle 22 passes.

The carrier 10 as described directly hereinbefore is complete and suitable for carrying articles. However, in the preferred embodiment depicted in the Figures the carrier 10 is fitted with end panels 42. The panels 42 conform with the bottom 14 and lower sidewalls 16 of the carrier 10 and are attached thereto. These panels 42 can be sewed, glued, heat sealed or otherwise joined to the web 12. In a preferred embodiment, the edges of the end panels 42 and web 12 are sewed together and reinforced with a decorative binding. The panels 42 are usually of a height such that when the upper portion of the sidewalls 16 are bent inwardly in closed position the handles 22 meet at about the center of the carrier 10 when resting on the upper edge of the panels 42.

Each of the end panels 42 can be fitted at the midpoint of its upper edge with a ring 44 of diameter sufficiently large to accommodate the end tips 26 of handles 22.

Figure 3:
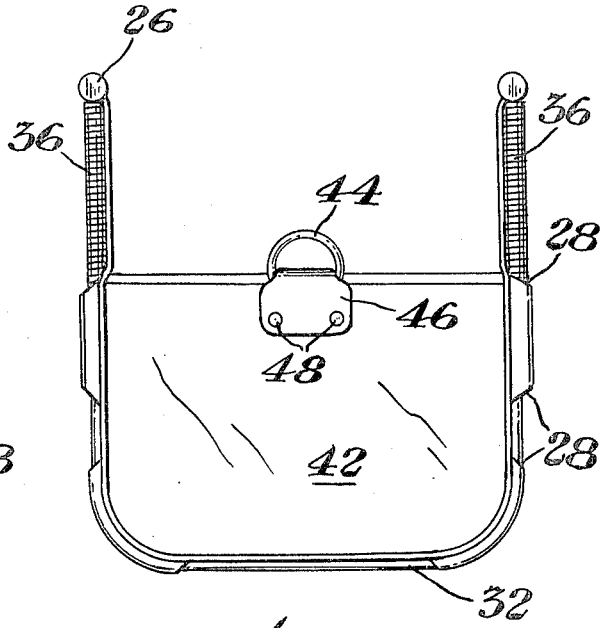
FIG. 3 is an end elevation of the carrier of FIG. 1 with the sidewalls in the same upright position as in FIG. 1.
Figure 4:
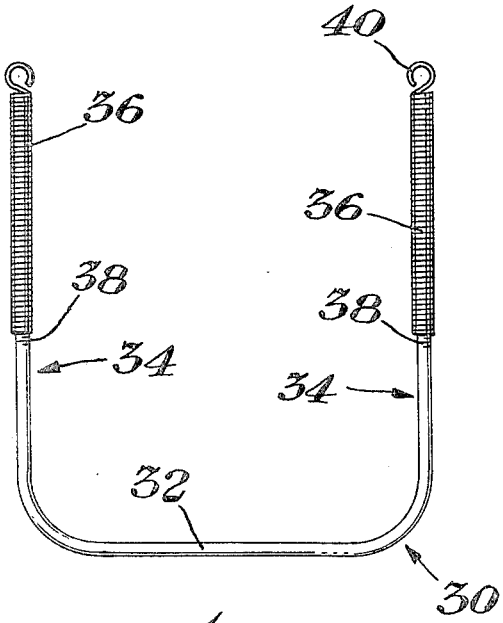
FIG. 4 is an end elevation of one of the frame support members of the carrier of FIG. 1.
Figure 5:
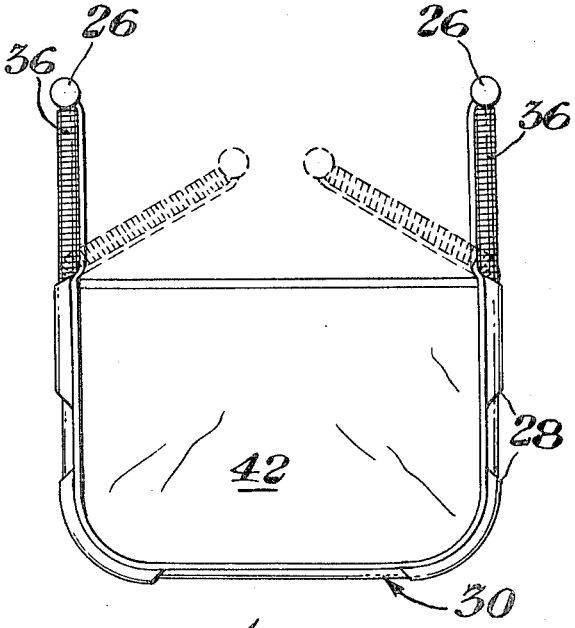
FIG. 5 is an end elevation of another preferred embodiment of the carrier of FIG. 1 but differs from that of the carrier of FIG. 1 in that it does not have a securing means for holding the sidewalls in a closed down position.

By providing handles 22 of a length slightly longer than the width of the web 12 of carrier 10, the ends of handles 22 can be slipped through rings 44 as shown in FIG. 3 to hold the sidewalls 16 in closed position.

The ring 44 as shown in the depicted embodiment is held in place by a loop of suitable strength flexible sheet material 46 and width which has one end on the outside of panel 42 and passes through the ring 44 and has its other end positioned on the inside of panel 42. The sheet member 46 is held in place by rivets 48 which pass through both ends of the member 46 and end panel 42. The ring 44 can be fastened to the end panel by other means, for example, such as having one side sewed or adhesively fastened to the panel 42.

I claim:

1. A self-standing carrier comprising an elongated, substantially rectangular, flexible web forming the bottom and sidewalls of said carrier, said carrier including end panels, each said end panel having a securing means for holding the upper sidewalls of said carrier in closed position, said web fitted with a tubular handle attached to each end of each upper sidewall, the ends of each said handle extending beyond the edge of the web, and said handles communicating with the securing means in the end panels of said carrier, said web fitted with a plurality of spaced apart generally ⊔-shaped supporting frame members of length about the same as said web, said ⊔-shaped members being positioned at spaced apart positions across the width of said web, said ⊔-shaped frame members defining the shape of the bottom and sidewalls of said carrier, the upper arm portions of said frame members being flexible thereby permitting the upper sidewalls of said carrier to bend inwardly and outwardly.

2. A self-standing carrier comprising a substantially rectangular, flexible web member, the ends of said web having an indented portion near its midpoint, a rigid tubular member affixed to each end of said web serving as a handle, said tubular member extending outwardly from the side edges of said web, a plurality of substantially ⊔-shaped frame members each fitted in an alternating pattern through a row of spaced apart openings extending along the length of said web, each of said frame members being fitted onto said web at a spaced apart interval from another of said frame members across the width of said web, the length of said web and said frame member being substantially the same, the ends of said frame members being fastened to said rigid, tubular handle members, the base and lower arm portions of each of said frame members being rigid and the upper arm portions of each of said frame members being flexible, said carrier being fitted with end panels, said panels conforming with the bottom and lower sidewalls of said carrier.

3. The carrier as defined in claim 2 wherein the end panels each is fitted with a ring of diameter to accommodate the ends of said handles, each of said rings being attached to said end panels near the midpoint at its upper edge.

4. The carrier as defined in claim 2 wherein the flexible upper arm portions of said frame members are coil springs, the length of said springs being such that in the inwardly bent position the handles meet at about the midpoint of the carrier at the top edge of the end panels.

* * * * *